US011608706B2

(12) United States Patent
Amos

(10) Patent No.: US 11,608,706 B2
(45) Date of Patent: Mar. 21, 2023

(54) SINGLE TRIP LINER RUNNING AND TIE BACK SYSTEM

(71) Applicant: SAUDI ARABIAN OIL COMPANY, Dhahran (SA)

(72) Inventor: Thankgod Chima Amos, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 53 days.

(21) Appl. No.: 17/184,210

(22) Filed: Feb. 24, 2021

(65) Prior Publication Data

US 2022/0268126 A1 Aug. 25, 2022

(51) Int. Cl.

| | |
|---|---|
| ***E21B 33/14*** | (2006.01) |
| ***E21B 23/06*** | (2006.01) |
| ***E21B 33/12*** | (2006.01) |
| ***E21B 34/06*** | (2006.01) |
| ***E21B 17/14*** | (2006.01) |
| ***E21B 43/10*** | (2006.01) |
| ***E21B 37/00*** | (2006.01) |
| ***E21B 33/129*** | (2006.01) |
| *E21B 3/02* | (2006.01) |

(52) U.S. Cl.

CPC ..... *E21B 33/14* (2013.01); *E21B 17/14* (2013.01); *E21B 23/06* (2013.01); *E21B 33/12* (2013.01); *E21B 33/129* (2013.01); *E21B 34/063* (2013.01); *E21B 37/00* (2013.01); *E21B 43/10* (2013.01); *E21B 3/022* (2020.05)

(58) Field of Classification Search

CPC ..... E21B 33/14; E21B 23/06; E21B 33/129; E21B 34/063

See application file for complete search history.

(56) References Cited

U.S. PATENT DOCUMENTS

| | | | | |
|---|---|---|---|---|
| 8,286,717 | B2 * | 10/2012 | Giroux | E21B 43/108 166/208 |
| 8,567,501 | B2 * | 10/2013 | Zimmerman | E21B 43/14 166/308.1 |
| 2018/0045018 | A1 | 2/2018 | Gaspard et al. | |
| 2018/0252053 | A1 * | 9/2018 | Rico | E21B 33/10 |
| 2018/0355693 | A1 | 12/2018 | Al-AbdulJabbar et al. | |
| 2019/0128115 | A1 * | 5/2019 | AlNughaimish | E21B 47/117 |

* cited by examiner

*Primary Examiner* — Catherine Loikith

(74) *Attorney, Agent, or Firm* — Osha Bergman Watanabe & Burton LLP

(57) ABSTRACT

A single trip liner running and tie-back system includes a liner string to case a formation, a polished bore receptacle installed in a liner hanger, and a tie back casing string to tie back the liner string to a wellhead. The tie back casing string is fit with a seal assembly comprised of a no-go stopper, and the seal assembly of the tie back casing string is anchored inside the polished bore receptacle of the liner hanger to run the liner string and the tie back casing string in tandem.

17 Claims, 7 Drawing Sheets

SINGLE TRIP LINER RUNNING AND TIE BACK SYSTEM

BACKGROUND

Hydrocarbon resources are often located below the earth's surface, sometimes tens of thousands of feet below the surface. In order to extract hydrocarbon fluids, that is, oil and/or gas, wells may be drilled to gain access to reservoirs found in subterranean porous rock formations. Wells may be drilled vertically into the earth or deviated from vertical, even up to horizontal in order to access subsurface hydrocarbon reservoirs most effectively and efficiently.

Wells may be cased to protect the integrity of the well and the surrounding formations through which the wellbore may pass. Casing may be fixed in place by injecting cement into the annulus between the casing and the surrounding formation or into the annulus between the outer diameter of the casing and the inner diameter of a previous casing string. For a plurality of conditions, a liner may need to be run in place of casing. The primary distinction between liner and casing, is that casing extends from the bottom of the hole to the surface and is supported by the wellhead, whereas liner only runs as high as the previous casing string and is anchored within the previous casing string.

In some cases, liner may need to be tied back to the wellhead. In such cases, a tie-back casing string is supported by the wellhead and run down to the depth of the top of the liner. In one or more embodiments, the liner string will be run in hole and cemented prior to the tie-back casing string entering the wellbore. This method typically requires multiple trips, running a mill, and negative testing.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a single trip liner running and tie-back system and a method for use of the system. In general, and in one embodiment, the system includes a liner string to case a formation, a polished bore receptacle installed in a liner hanger, and a tie back casing string to tie back the liner string to a wellhead. The tie back casing string is fit with a seal assembly comprised of a no-go stopper and the seal assembly of the tie back casing string is anchored inside the polished bore receptacle of the liner hanger to run the liner string and the tie back casing string in tandem.

In some embodiments, a method for cementing the single trip liner running and tie-back system includes running the single trip liner running and tie-back system into a wellbore with a no-go stopper installed in a seal assembly to prevent pre-mature shearing. Cementing a liner string in place by pumping a volume of cement through a float shoe, setting a set of slips and a packer, breaking shear pins, and cementing a tie-back casing string through cementing ports.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
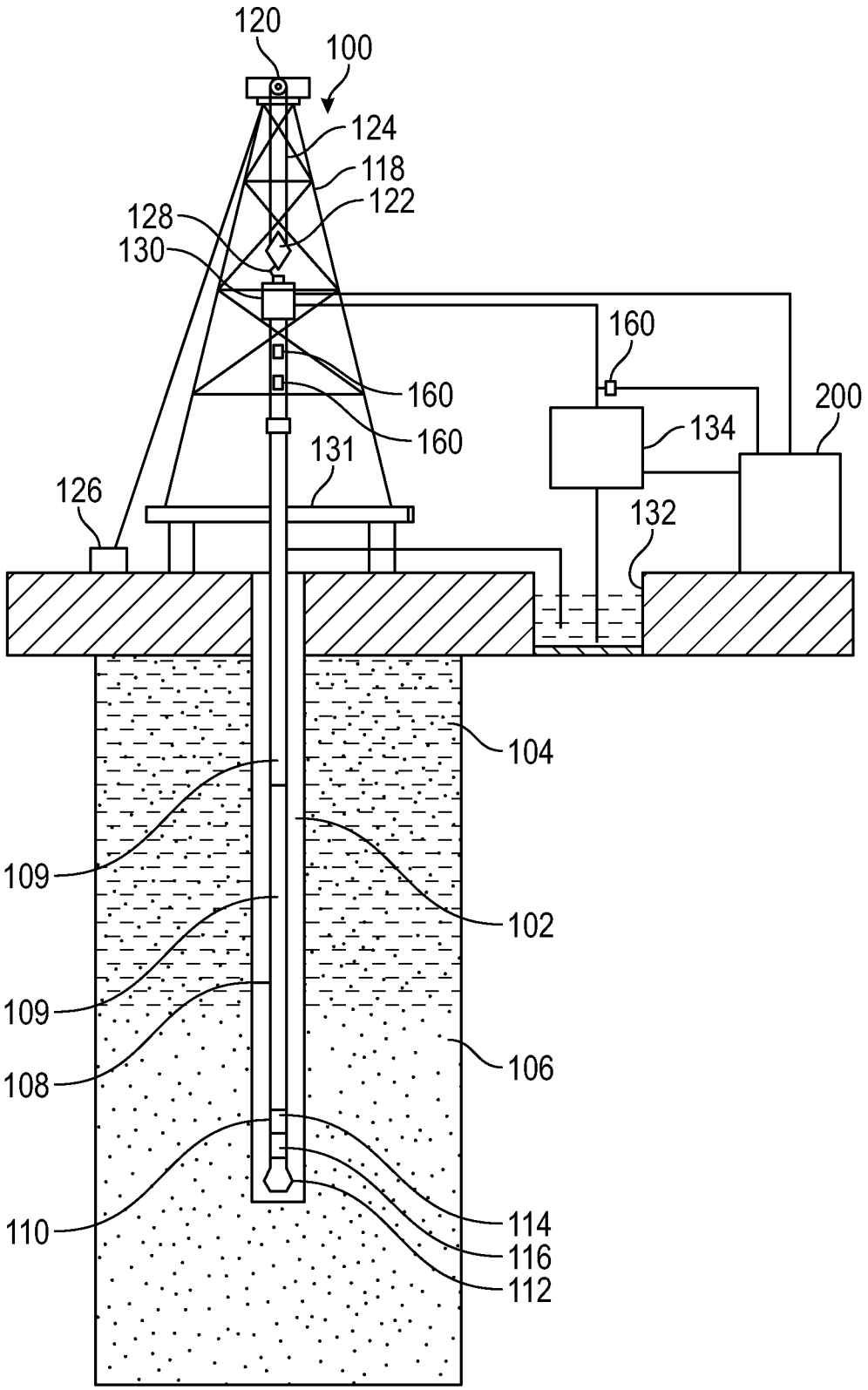
FIG. 1 is a schematic diagram of an exemplary well site in accordance with one or more embodiments.

FIG. 1 illustrates an exemplary well site (100). In general, well sites may be configured in a myriad of ways. Therefore, well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102). The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that can be used to adjust the length of the cable (124) so that the traveling block (122) may move up or down the derrick (118). The traveling block (122) may include a hook (128) on which a top drive (130) is supported. The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (200) may be disposed at or communicate with the well site (100). System (200) may control at least a portion of a drilling operation at the well site (100) by providing controls to various components of the drilling operation. In one or more embodiments, system (200) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation). Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108). The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (200).

Figure 2:
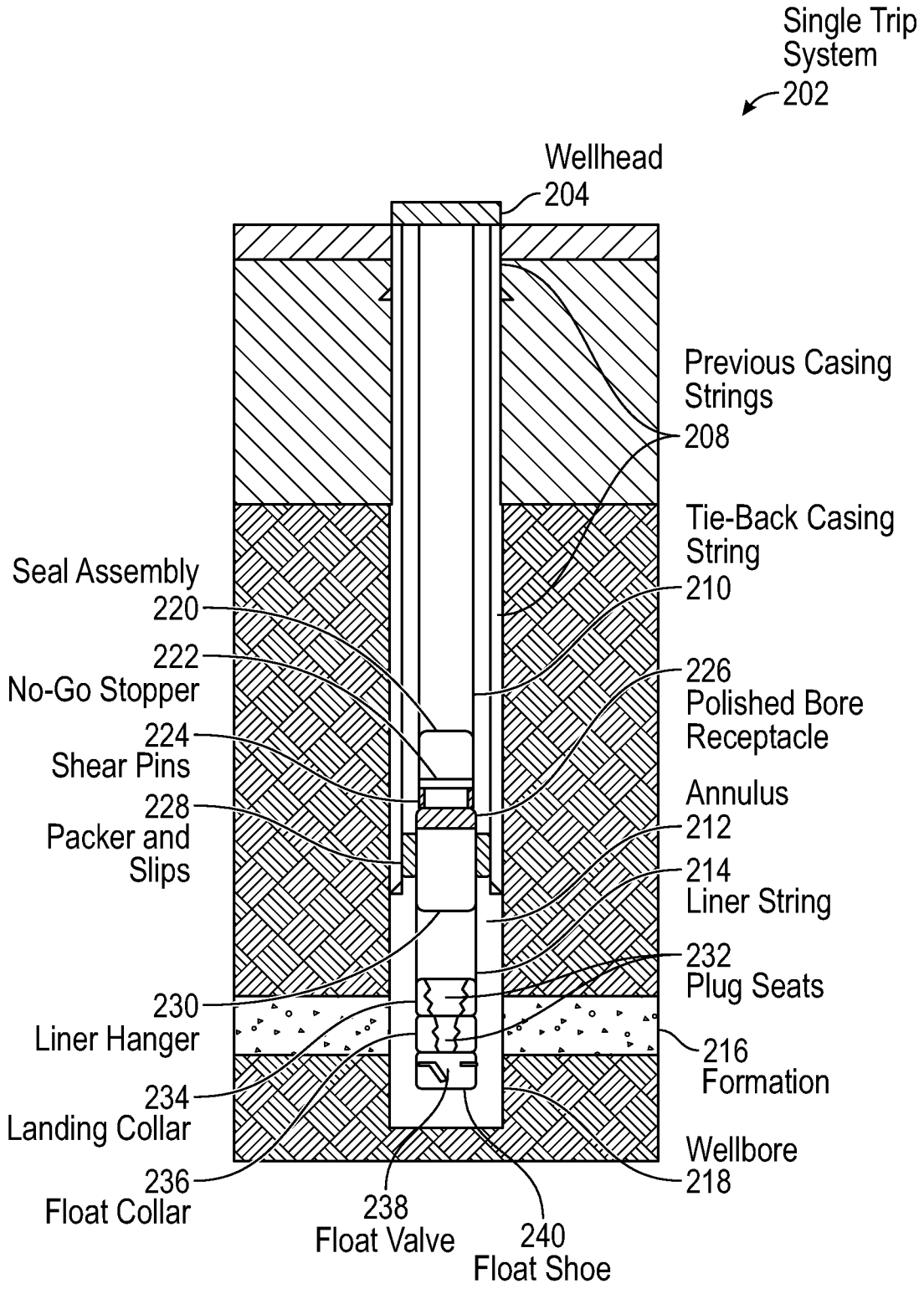
FIG. 2 is a schematic diagram of a single trip liner and tie-back system in accordance with one or more embodiments.

FIG. 2 depicts, in one or more embodiments, a proposed layout of a single trip liner and tie-back system (202), herein named "the single trip system (202)". The depicted single trip system (202) may allow a liner string (214) to be run into a wellbore (218) in tandem with a tie-back casing string (210). The liner string (214) may be comprised of a float shoe (240). A float shoe (240) may have a float valve (238) which helps in well control and possible floating of the casing. The float valve (238) is installed to allow forward flow of fluids, but will prevent reverse flow, or u-tubing, from occurring. The float shoe (240) also helps guide the liner string (214) into the center of the wellbore (218) to avoid hitting any obstructions, such as ledges or washouts, that exist. The float shoe (240) helps guide the liner string (214) in the wellbore (218) by the shape of the float shoe's (240) nose.

In one or more embodiments, the float shoe (240) may be connected to a float collar (236). The float collar (236) provides a plug seat (232) to house the bottom plug used in a conventional two-plug cementing system. A landing collar (234) may be connected to the float collar (236). The landing collar (234) may provide a plug seat (232) to house the top plug used in a conventional two-plug cementing system. In other embodiments, the float collar (236) may house both the bottom and top plug or the landing collar (234) may house both the bottom and top plug. Furthermore, the internal components of the float collar (236), landing collar (234), and float shoe (240) may be made of material, such as plastic, that can be drilled out to allow for production of oil and/or gas up the single trip system (202) or to allow for further growth of the wellbore (218).

The liner string (214) is anchored inside of the previous casing string (208) by the liner hanger (230). The liner hanger (230) may be comprised of a packer and slips (228), the packer and slips (228) are the components that physically anchor the liner string (214) in the previous casing string (208). The liner hanger (230) may have a polished bore receptacle (226) installed to provide a connection for the tie-back casing string (210). The polished bore receptacle (226), in further embodiments, may provide a housing for production tubing to sting into. The polished bore receptacle (226) may be attached to a seal assembly (220) of the tie-back casing string (210) through a plurality of shear pins (224). The shear pins (224) may be set to break at a pre-determined tensile force. The seal assembly (220) of the tie-back casing string (210) may house a no-go stopper (222) to prevent the pre-mature shearing of the shear pins (224). The no-go stopper (222) prevents pre-mature shearing by preventing unintentional weight transfer to the shear pins (224) when the single trip system (202) hits any obstructions while running in hole.

The single trip system (202) may be run in a plurality of conditions. One such condition may develop when a weak formation (216) is encountered. A weak formation (216) may be a formation (216) that has a low fracture pressure compared to the surrounding formations or a formation (216) that has an abnormally low fracture pressure for formations at that depth. Certain weak formations (216) may fracture during cementing operations because the equivalent circulating density (ECDs) of the cement may surpass the fracture pressure of the formation (216). When the fracture pressure is surpassed, cement may be lost to the formation (216) and a cement job may not be completed. A major factor effecting ECDs is the height of cement in the annulus (212). A way to lower ECDs and achieve a good cement barrier across the formation (216) is to run the single trip system (202) to a depth below the weak formation (216) and cement the liner string (214) to a height below the packer and slips (228). In other embodiments, the top of cement may be above the packer and slips (228), covering the seal assembly (220), such that when the tie-back casing string (210) is cemented, residual cement may be circulated out to ensure the entire single trip system (202) is cemented. More specifically, cement may be placed 200 to 300 feet above the liner string (214). Once the liner string (214) has been cemented, the weak formation (216) has been isolated, and the tie-back casing string (210) may be cemented to the required height. Those skilled in the art will appreciate that embodiments disclosed herein are not limited to encountering weak formations (216) and any situation that could reasonably utilize the single trip system (202) may be used without departing from the scope herein.

Figure 3B:
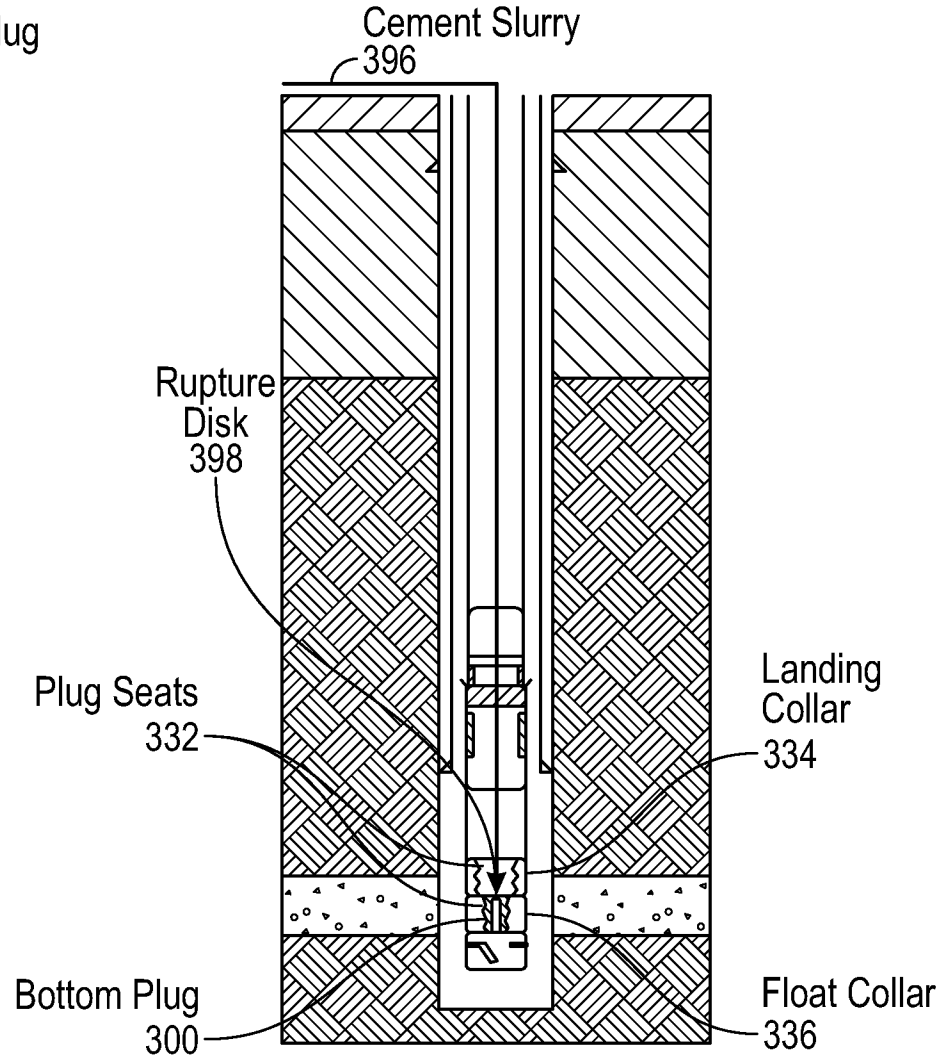
FIG. 3*a*-3*d* are schematic diagrams depicting four stages of a conventional two-plug cementing operation in accordance with one or more embodiments.
Figure 3A:
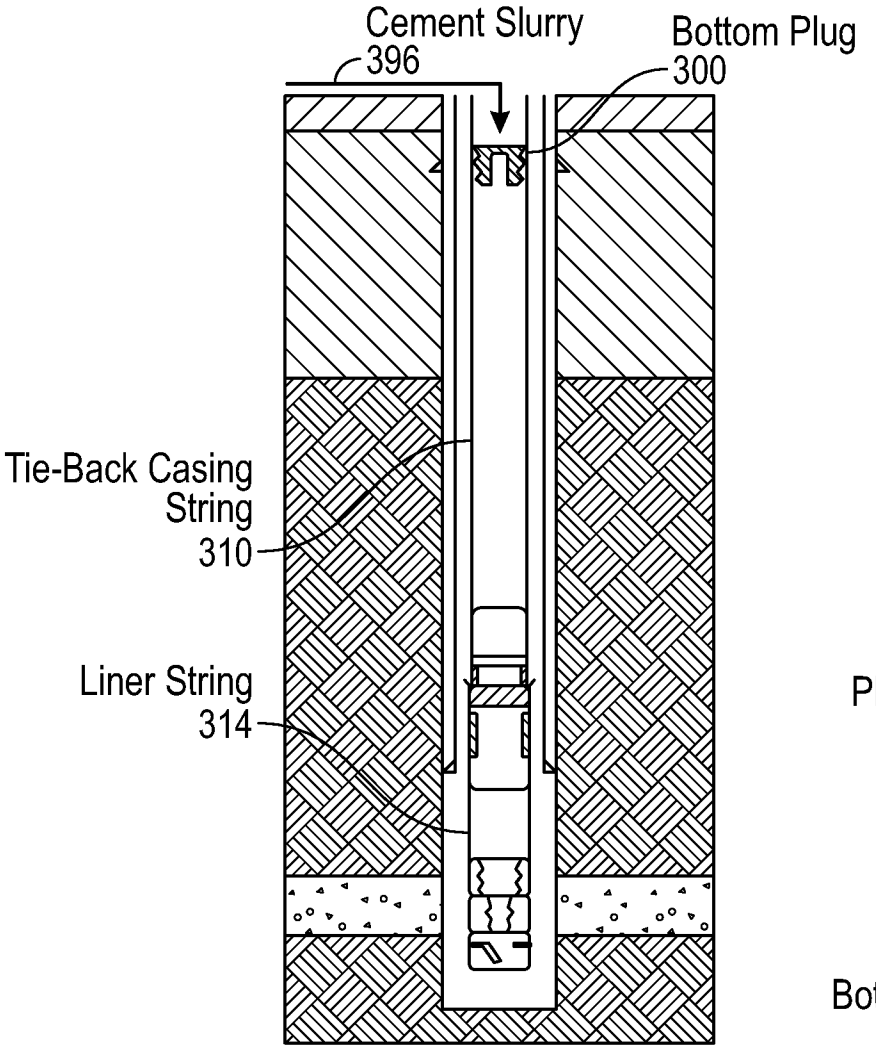

FIGS. 3*a*-3*d* depict a two-plug cementing operation that, in one or more embodiments, may be a method used to cement the liner string (314) in place. FIG. 3*a* depicts the first stage of cementing the liner string (314) in place after the single trip system (202) has been tripped to a pre-determined depth. A hollow bottom plug (300) may be pumped into the tie-back casing string (310) by pumping a cement slurry (396) behind the bottom plug (300). The bottom plug (300) helps prevent any prior drilling fluid from intermixing with the cement slurry (396). When drilling fluid and cement mix, the cement job may be compromised, because the cement may no longer have the required values of certain cement parameters, such as setting time or compressive strength. The bottom plug (300) also helps scrape off any mud film that may be on the inner surface of the tie-back casing string (310) and the liner string (314).

FIG. 3*b*, in one or more embodiments, depicts a second stage of the two-plug cementing operation. FIG. 3*b* depicts placing the bottom plug (300) into a plug seat (332). In this embodiment, the plug seat (332) for the bottom plug (300) is located in the float collar (336), but in other embodiments the plug seat (332) for the bottom plug (300) may be located in the landing collar (334). The bottom plug (300) may be placed into the plug seat (332) using the cement slurry (396) to pump the bottom plug (300) in place.

When the bottom plug (300) has been placed into the plug seat (332), the pressure from the cement slurry (396) being pumped will cause the rupture disk (398) to burst. The rupture disk (398) may be located on the upper surface of the bottom plug (300). The rupture disk (398) is solid and prevents the cement slurry (396) from passing through the hollow bottom plug (300) until a certain pressure is reached on the surface of the rupture disk (398). In one or more embodiments, the rupture disk (398) is set to burst at a pressure that will not be seen until the bottom plug (300) has been placed in the plug seat (332).

Figure 3D:
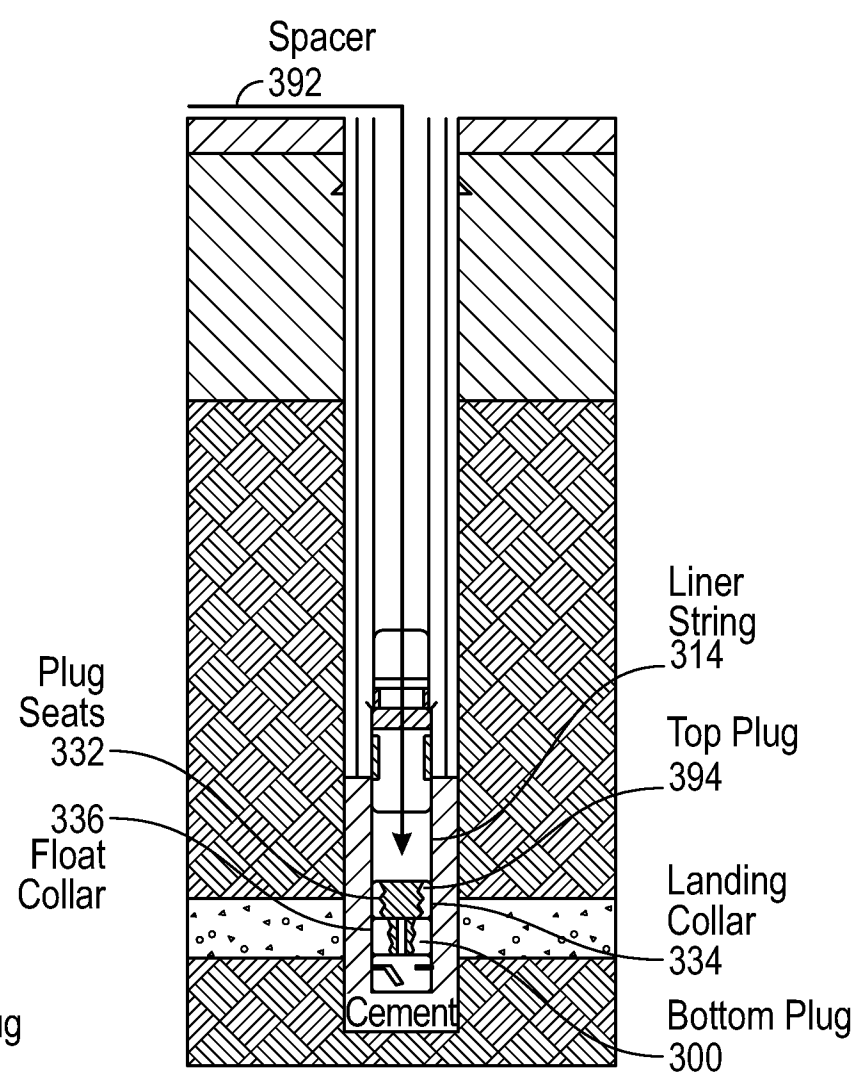
Figure 3C:
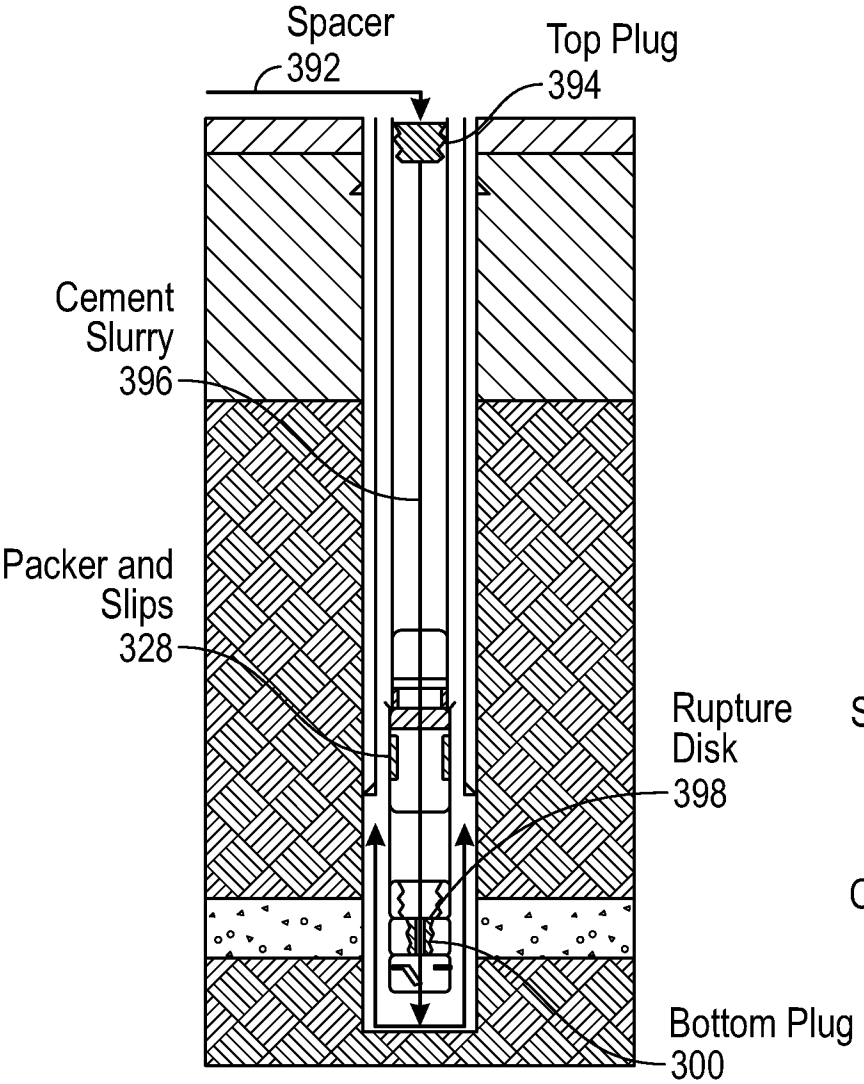

FIG. 3*c* depicts the cement slurry (396) passing through the bottom plug (300) after the rupture disk (398) has burst. The remainder of a pre-determined volume of cement, that will reach a height below the packer and slips (328), may be pumped followed by the top plug (394). In other embodiments, the pre-determined volume of cement may be a volume of cement that will reach a height above the packer and slips (228), covering the seal assembly (220). In one or more embodiments, the top plug (394) may be solid and may be designed to not allow any fluid to pass through. The top plug (394) may be pumped downhole using a spacer (392), or the top plug (394) may be pumped using the cement slurry (396).

FIG. 3*d* depicts the top plug (394) being placed into the plug seat (332) of the landing collar (334). In one or more embodiments, the plug seats (332) may be located in the float collar (336) so both the bottom plug (300) and the top plug (394) may be located in the float collar (336). In further embodiments, the plug seats (332) may be located in the landing collar (334) so both the bottom plug (300) and the top plug (394) may be located in the landing collar (336). Those skilled in the art will appreciate that embodiments disclosed herein are not limited to utilizing the two-plug cementing operation to cement the liner string (314) in place and any method of cementing the liner string (314) in place, such as a single plug cementing operation, may be used without departing from the scope herein.

Figure 4:
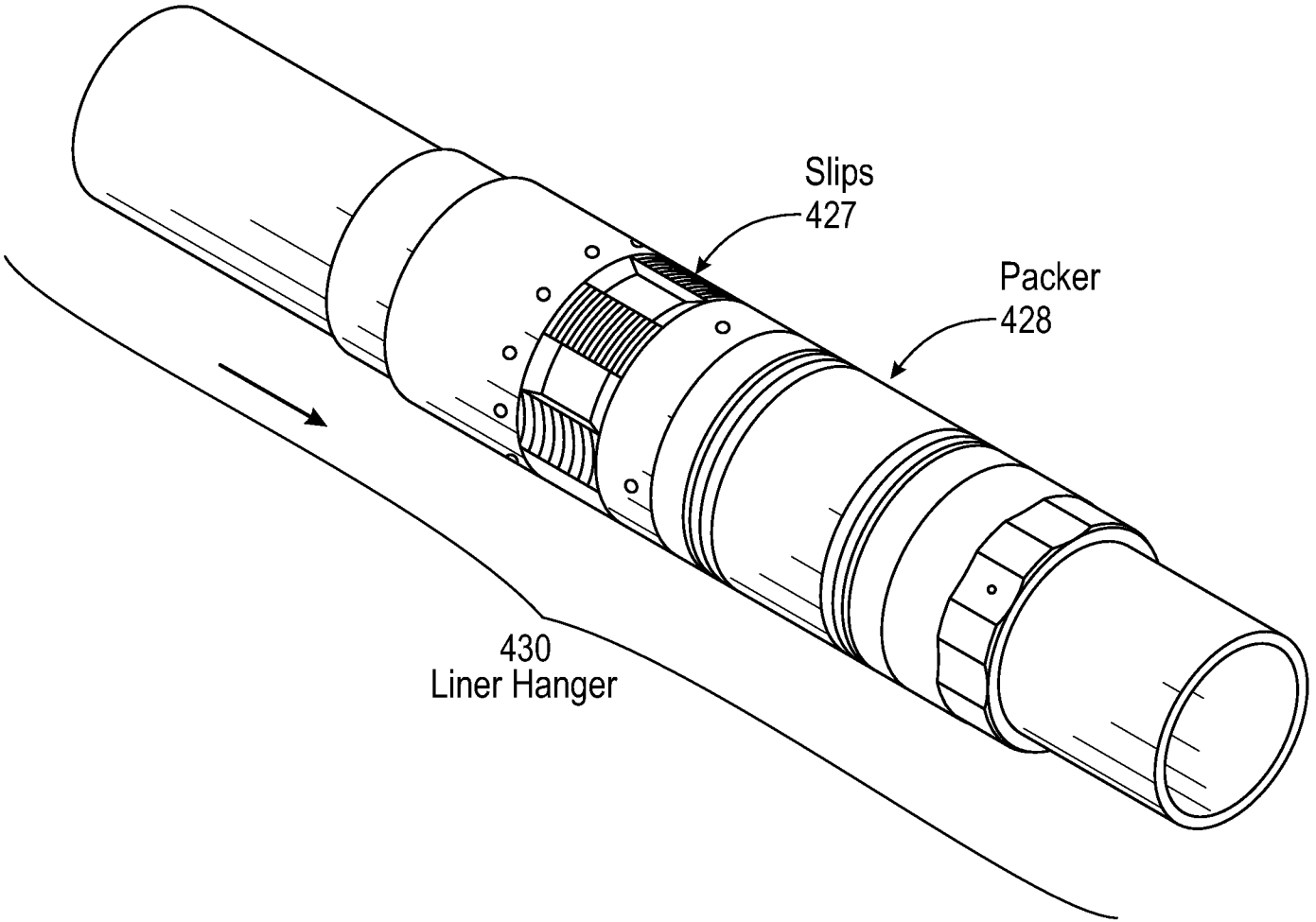
FIG. 4 is a schematic diagram depicting the components of a liner hanger in accordance with one or more embodiments.

FIG. 4 depicts, in one or more embodiments, a schematic of a liner hanger (430) with a set of slips (427) and a packer (428). The slips (427), once set, bite into the previous casing string (208) to physically hold up the liner string (214, 314). The packer (428), once set, provides a pressure seal so fluids and pressure may not migrate through the packer, and the annulus (212) located below the packer (428) may be isolated from the annulus (212) located above the packer (428). The slips (427) and the packer (428) may be set after the liner string (214, 314) is cemented in place. The slips (427) and the packer (428) may be set hydraulically, mechanically, or a combination of the two. In one or more embodiments, the packer (428) and slips (427) may be set by applying a compressive force across the liner hanger (430) using fluid pressure.

Figure 5:
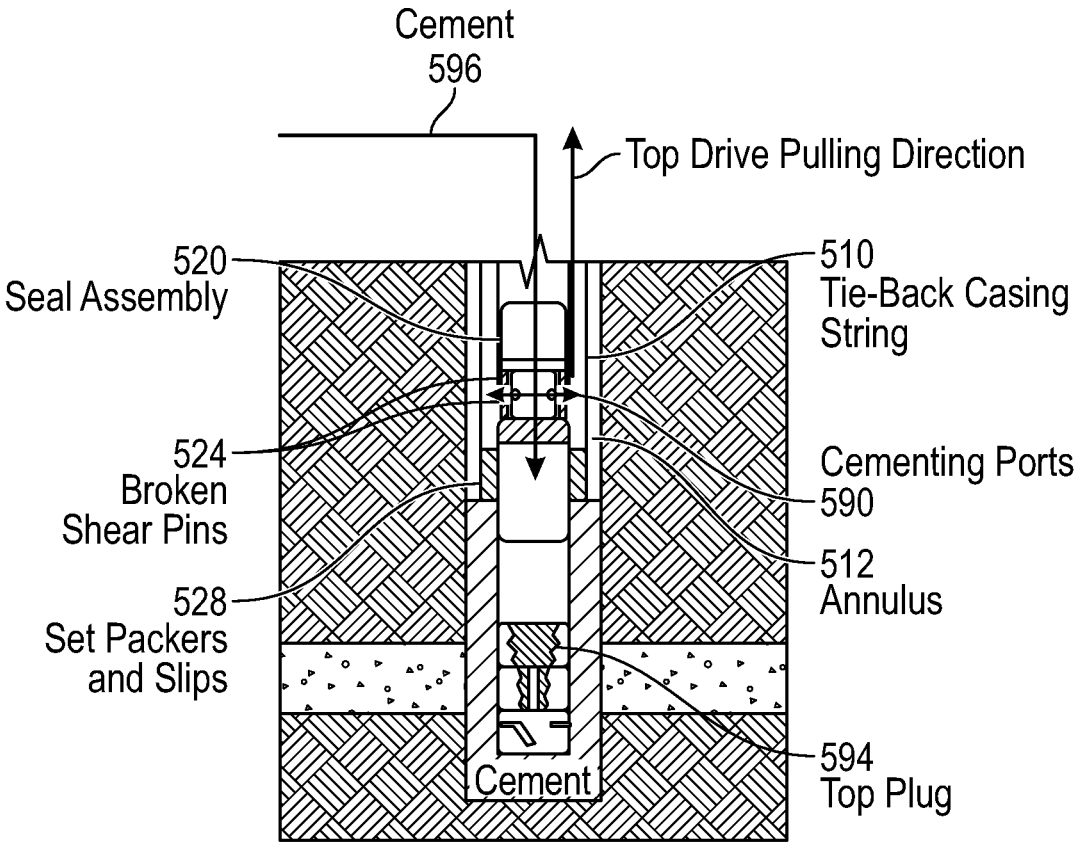
FIG. 5 is a schematic diagram depicting the process of cementing a tie-back casing string in accordance with one or more embodiments.

FIG. 5 depicts the schematic of the single trip system (202) after the packer and slips (528) have been set and the shear pins (524) have been broken. In one or more embodiments, the shear pins (524) may be broken by reaching a pre-determined tensile force across the shear pins (524). This tensile force may be reached by simultaneously pulling up on the tie-back casing (510), using a top drive (130), and applying fluid pressure, by pumping fluid on top of the top plug (594). With the shear pins (524) broken, the top drive (130) may pull the tie-back casing string (510) in an upward direction to reveal cementing ports (590) located within the seal assembly (520). The tie-back casing string (510) may be cemented by pumping a cement slurry (596) through the cementing ports (590) and into the annulus (512). The tie-back casing string (510) may be cemented to surface, or the tie-back casing string (510) may be cemented to a pre-determined height below the surface.

Figure 6:
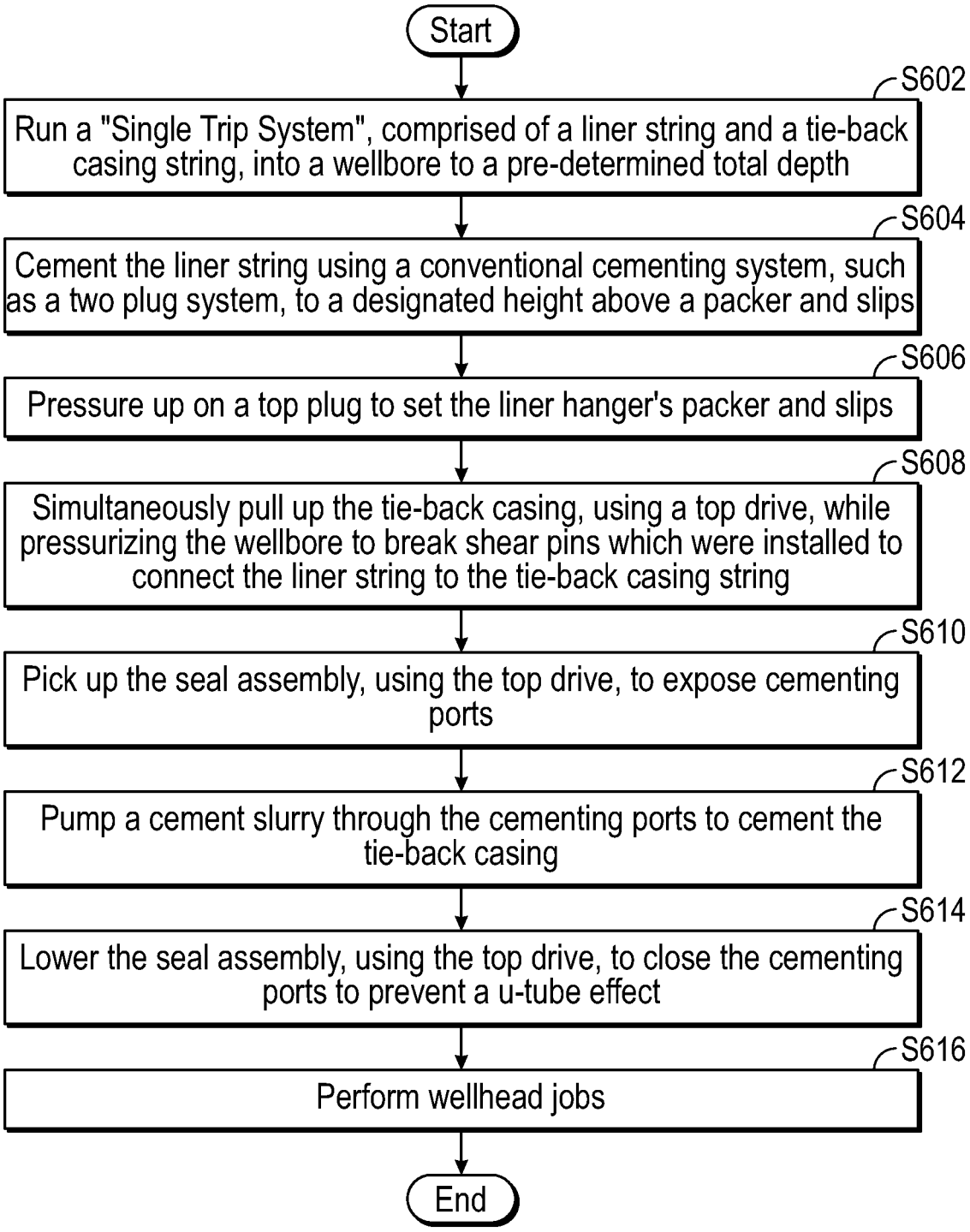
FIG. 6 shows a flowchart in accordance with one or more embodiments.

FIG. 6 shows a flow chart for cementing the single trip system (202), in accordance with one or more embodiments. Further, one or more blocks in FIG. 6 may be utilizing one or more components as described in FIG. 2 (e.g., liner hanger (230)). While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In one or more embodiments, the single trip system (202), comprised of a liner string (214, 314) and a tie-back casing sting (210, 310, 510), is run into a wellbore (218) to a pre-determined total depth (S602). The liner string (214, 314) may be comprised of a float shoe (240), a float collar (236, 336), a landing collar (234, 334), a liner hanger (230, 430), and a polished bore receptacle (226). The tie-back casing string (210, 310, 510) may be comprised of a seal assembly (220, 520). The seal assembly (220, 520) may have a no-go stopper (222) installed. The liner string (214, 314) may be connected to the tie-back casing string (210, 310, 510) through one or more shear pins (224, 524) attaching the polished bore receptacle (226) to the seal assembly (220, 520).

Step S604 describes a way to cement the liner string (214, 314) in one or more embodiments. The method of cementing depicted in Step S604 uses a two-plug cementing method. This method comprises pumping a hollow bottom plug (300) with a rupture disk (398) to a plug seat (232, 332) in either a float collar (236, 336) or a landing collar (234, 334). The rupture disk (398) is set to burst when a certain pressure is met on the rupture disk's (398) surface. Once the rupture disk (398) bursts, a cement slurry (396, 596) may be able to pass through the bottom plug (300) and out the float shoe (240) to enter the annulus (212, 512). A pre-determined volume of cement is pumped followed by a solid top plug (394, 594). The solid top plug may be pumped into the single trip system (202) using a cement slurry (396, 596) or a spacer (392). The solid top plug may be set in a plug seat (232, 332) located in either the float collar (236, 336) or the landing collar (234, 334).

Step S606 depicts a method of setting the liner hanger's (230, 430) packer and slips (228, 328). This method describes pressuring up on the top plug (394, 594), using fluid pressure, to obtain a pre-determined compressive force across the liner hanger (230, 430). Upon reaching this compressive force, the packer and slips (228, 328) may set. A successfully set packer and slips (228, 328) may hold the liner string (214, 314) in place and prevent migration of fluids in the annulus (212, 512) below and above the packer (428). A top drive (130) may then pull the tie-back casing string (210, 310, 510), in an upward direction, to induce a tensile force upon the shear pins (224, 524). The fluid pressure may then be increased to exaggerate the tensile force across the shear pins (224, 524). The shear pins (224, 524) will break when a pre-determined tensile force is reached. (S608). The seal assembly (220, 520) may be picked up by having the top drive (130) pull up the tie-back casing string (210, 310, 510). The seal assembly (220, 520) will expose cementing ports (590) to the annulus (212, 512) (S610).

Step S612 depicts a method of cementing the tie back casing string. A cement slurry (396, 596) may be pumped down the single trip system (202), out of the cementing ports (590), and into the annulus (212, 512). The tie-back casing string (210, 310, 510) may be cemented to surface or to a pre-determined depth below the surface. As described in Step S614, the seal assembly (220, 520) is lowered by the top drive (130) to close the cementing ports (590) to the annulus (212, 512). This prevents the cement from u-tubing into the tie-back casing (210, 310, 510) and wellhead (204) jobs may be performed (S616). The single trip system (202) and the associated method for cementing, as laid out in FIG. 6, provides a method to avoid multiple trips, running a mill, and negative testing in situations when a liner string (214, 314) and a tie-back casing string (210, 310, 510) are part of the completions strategy of a well.

Those skilled in the art will appreciate that although embodiments disclosed herein employ certain cementing methods and certain setting methods, other methods may be used (such as a one-plug cementing method or tension setting methods) without departing from the scope of this disclosure.

What is claimed:

1. A single trip liner running and tie-back system, comprising:

a liner string to case a formation;

a polished bore receptacle installed in a liner hanger; and a tie back casing string to tie back the liner string to a wellhead, wherein the tie back casing string is fit with a seal assembly comprised of a no-go stopper and the seal assembly of the tie back casing string is anchored inside the polished bore receptacle of the liner hanger to run the liner string and the tie back casing string in tandem, wherein the liner string comprises:

the polished bore receptacle installed in the liner hanger;

a landing collar to provide a seat for a top wiper plug;

a float collar to provide a seat for a bottom wiper plug; and a float shoe to allow access to a wellbore.

2. The system of claim 1, wherein the no-go stopper prevents pre-mature shearing while running the single trip liner running and tie-back system into a wellbore.

3. The system of claim 1, further comprising:

hanger slips; and a packer, wherein the packer and the hanger slips are installed in the liner hanger.

4. The system of claim 3, wherein the packer and the hanger slips are set by reaching a pre-determined compressive force, applied by fluid pressure, across the liner hanger.

5. The system of claim 1, wherein a float valve is installed in the float shoe to prevent backflow of fluid and to provide access to the wellbore for placement of cement.

6. The system of claim 1, wherein the bottom wiper plug is comprised of a hollow core beneath a rupture disk and the top wiper plug is comprised of a solid core.

7. The system of claim 6, wherein the rupture disk will rupture when a pre-determined compressive force is applied across the bottom wiper plug to allow for fluid to pass through.

8. The system of claim 1, wherein the seal assembly is anchored inside the polished bore receptacle using shear pins.

9. The system of claim 8, wherein the shear pins are set to break when a tensile force, applied through overpull and fluid pressure, is reached across the shear pins.

10. The system of claim 8, wherein the seal assembly houses cementing ports that are revealed when the shear pins break, and a tensile force is applied across the seal assembly.

11. A method to cement a single trip liner running and tie-back system, comprising:

installing a polished bore receptacle in a liner hanger connected to a liner string;

installing a seal assembly in a tie-back casing string, wherein the seal assembly is anchored inside a polished bore receptacle to run the liner string in tandem with the tie-back casing string;

running the single trip liner running and tie-back system into a wellbore with a no-go stopper installed in the seal assembly to prevent pre-mature shearing;

cementing the liner string in place by:

dropping a hollow bottom plug with a rupture disk to a seat in a float collar;

pressuring up, by pumping cement, on the bottom plug to rupture the rupture disk;

pumping a volume of cement through a float shoe and into an annulus; and displacing a solid top plug to a seat in a landing collar;

setting a set of slips and a packer;

breaking shear pins; and cementing a tie-back casing string through cementing ports.

12. The method of claim 11, wherein the volume of cement will fill the annulus of the wellbore to a depth above the slips and packer.

13. The method of claim 11, wherein the slips and the packer, installed on the liner hanger, are set by pumping on the top plug to achieve a pre-determined compressive force across the liner hanger.

14. The method of claim 11, wherein the shear pins are broken by simultaneously pulling up on a top drive and pumping on the top plug to reach a pre-determined tensile force across the shear pins.

15. The method of claim 11, wherein the tie-back casing string is cemented by a method comprising:

revealing the cementing ports to the annulus;

pumping a volume of cement into the annulus through the cementing ports;

closing the cementing ports; and allowing the cement to set.

16. The method of claim 15, wherein the cementing ports are revealed to the annulus by exerting an upwards force, using a top drive, on the tie-back casing string.

17. The method of claim 15, wherein the cementing ports are closed by exerting a downward force, using a top drive, on the tie-back casing string.

* * * * *